United States Patent [19]

Bunnelle

[11] 4,134,619

[45] Jan. 16, 1979

[54] SUBTERRANEAN MINING

[75] Inventor: Philip R. Bunnelle, Santa Clara, Calif.

[73] Assignee: FMC Corporation, San Jose, Calif.

[21] Appl. No.: 833,423

[22] Filed: Sep. 15, 1977

[51] Int. Cl.[2] ..... E21B 43/28

[52] U.S. Cl. ..... 299/17; 175/215; 285/137 A

[58] Field of Search ..... 299/17; 175/67, 213, 175/215; 285/137 R, 137 A; 138/113; 166/222, 223; 37/62

[56] References Cited

U.S. PATENT DOCUMENTS

| | | | |
|---|---|---|---|
| Re. 29,021 | 11/1976 | Archibald et al. | 175/213 |
| 3,153,290 | 10/1964 | Saito | 166/222 X |
| 3,730,592 | 6/1971 | Wenneborg et al. | 299/17 |
| 4,067,596 | 1/1978 | Kellner et al. | 175/215 X |

*Primary Examiner*—Ernest R. Purser
*Attorney, Agent, or Firm*—A. J. Moore; Frank Ianno

[57] ABSTRACT

Method and apparatus for mining an underground ore stratum with a drilling and mining tool which first drills a hole into the strata as it is assembled section by section until a desired depth is reached. The tool includes an outer conduit that is screwed together and at least two stab fitted inner conduits that are rotatable relative to the outer conduit for providing at least three conduit systems for conducting processing fluids into and out of the ore strata; and means for independently controlling, from the surface, the rate of flow in each conduit. During mining, one conduit system directs the flow of a mining liquid downwardly and into the ore stratum through a mining nozzle to create a slurry of ore and liquid, a second conduit system directs a slurry lifting fluid downwardly into and through a slurry lifting means, while a third conduit system conducts the slurry to the surface. During drilling, flow switching means communicating with one of the conduit systems is provided to direct a fluid through a drill bit into the hole being formed to wash the cuttings to the surface. During both drilling and mining the portion of the tool extending into the hole is rotated. In the first illustrated embodiment the slurry is lifted by an eductor pump, while an air lift is provided for additional embodiments.

54 Claims, 11 Drawing Figures

FIG_1
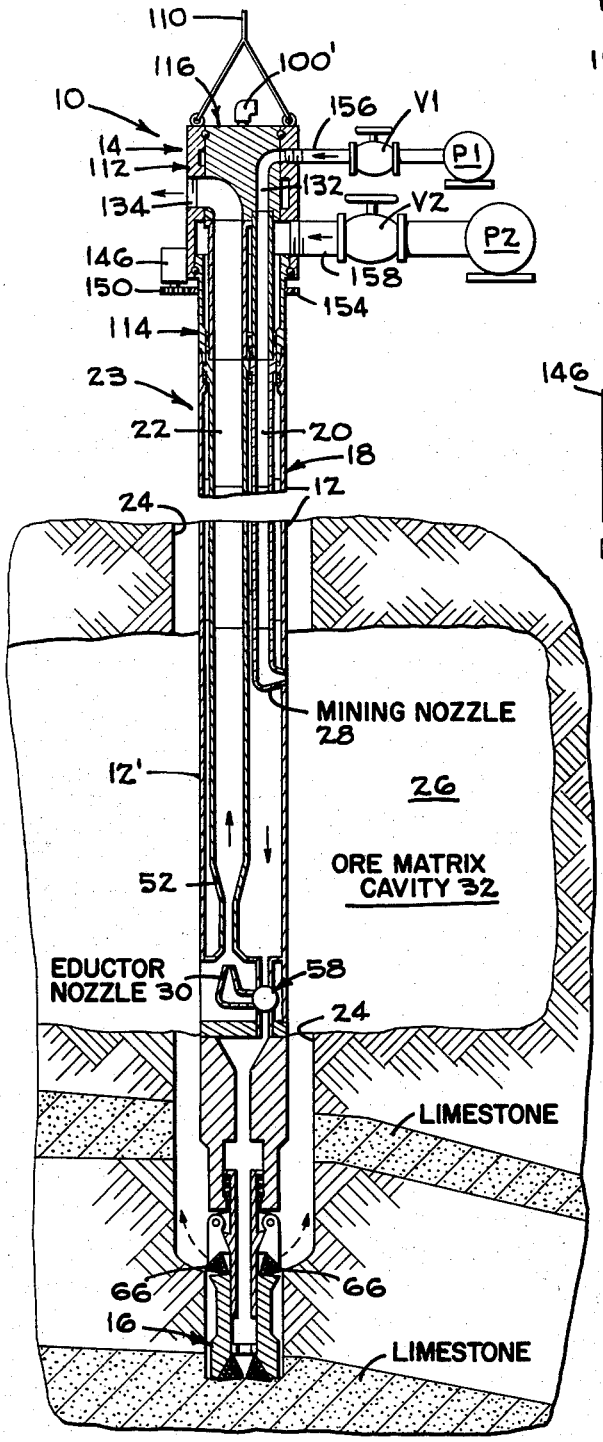
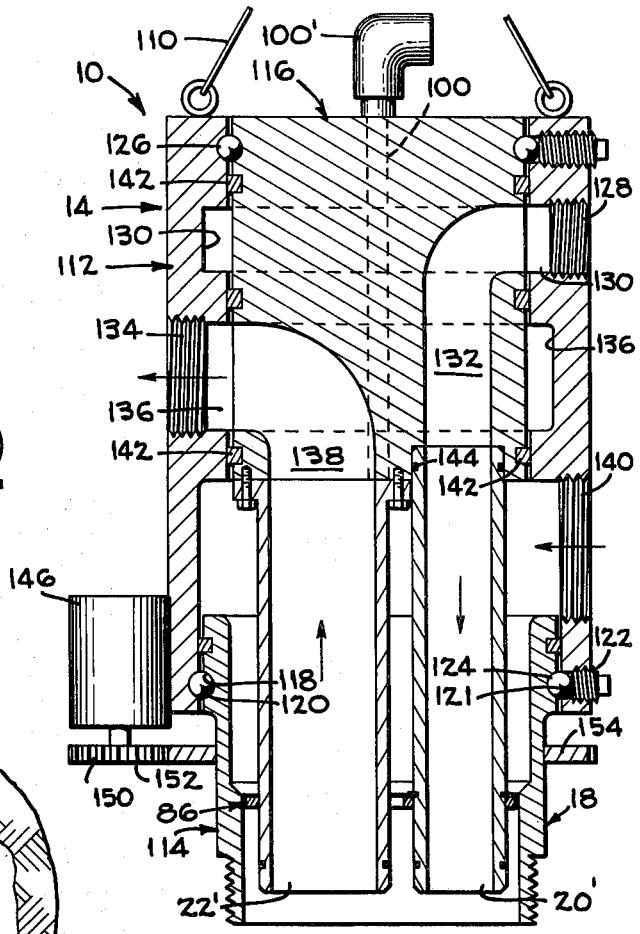
FIG_2
FIG_10
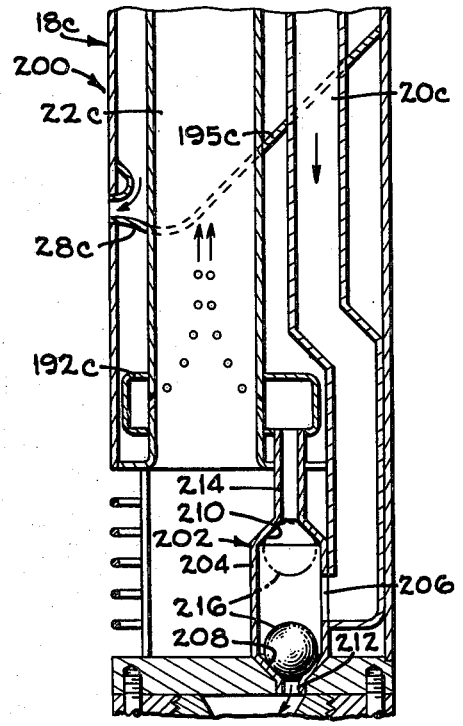

SUBTERRANEAN MINING

CROSS REFERENCE TO RELATED APPLICATIONS

My copending United States Patent Applications Ser. No. 704,277 now U.S. Pat. No. 4,077,481 which issued on Mar. 7, 1978; and No. 704,278 now U.S. Pat. No. 4,059,166 which issued on Nov. 22, 1977; both of which were filed on July 12, 1976 are pertinent to the present invention. The disclosure of these two applications are incorporated by reference herein.

BACKGROUND OF THE INVENTION

1. Field of the Invention

This invention relates to subterranean slurry mining and more particularly relates to a method and apparatus for drilling and mining one or more layers of granular ore, such as phosphate or coal, without withdrawing the apparatus from the hole between the drilling and mining modes of operation.

2. Description of the Prior Art

Subterranean slurry mining of phosphates or the like is broadly known in the art as evidenced by United States Wenneborg et al. U.S. Pat. Nos. 3,730,592 and 3,747,696 which issued on May 1, 1973 and July 24, 1973, respectively, and are assigned to the assignee of the present invention. The disclosures of both of these patents are incorporated by reference herein.

The modified embodiment of the device disclosed in Wenneborg et al 3,747,696 is the most pertinent prior art embodiment and comprises a combination drilling and slurry mining apparatus which may be changed between its drilling mode of operation and its mining mode of operation to mine several different layers of ore without requiring that the apparatus be pulled out of the hole. However, both Wenneborg patents disclose apparatus having only two conduit strings for conducting processing fluids into, and the slurry out of the ore strata.

Wenneborg et al 3,730,592 discloses a method which contemplates the use of surface controlled pressures equal to or in excess of the drilling pressure for shifting the mining nozzle, the eductor nozzle, and the drilling bit valve between the drilling mode and the mining mode. In addition, the patentee discloses the use of control pressures which lie in a range between the drilling pressure and the mining pressure for modulating the mining nozzle. Modulation of the mining nozzle is effective to control the cavity pressure, and also the liquid level in the mined cavity to vary the mining conditions for the particular stratum being mined.

United States parent and divisional U.S. Pat. Nos. 3,155,177 and 3,316,985 which issued to Fly on Nov. 3, 1964 and May 2, 1967, respectively, disclose a method and apparatus for under-reaming or slurry mining a hole and can also be controlled to alternately bore deeper and mine other strata in the hole after the first boring and mining operations have been completed. Valves operated by electric motors located within the tool string convert the apparatus from a drilling operation to a mining operation. The amount of force that can be applied to convert the apparatus from the drilling operation to the mining operation is, accordingly, limited by the size of the electric motors that can fit within the tool spring.

Andrews U.S. Pat. No. 1,071,199 dated Aug. 26, 1913 discloses a drill bit mounted on the lower ends of concentric pipes with the inner pipe communicating with the material removed by the bit. During drilling, water is forced into the hole outside of the outer pipe and raises with the cuttings into the inner pipe. Compressed air is forced downwardly between the outer and inner pipes and enters the lower end of the inner pipe for pumping or lifting the cuttings upwardly to the surface.

U.S. Pat. No. 2,518,591 which issued to Ashton et al on Aug. 15, 1950 discloses a jet mining and excavating apparatus wherein jets of water are used to sink bore holes into alluvial deposits. In one embodiment a combined sinking and excavating unit is provided wherein water moves downwardly within an outer conduit and through vertical and horizontal nozzles into the hole. In another embodiment the apparatus includes a sinking unit and a separate excavating unit which is substituted for the sinking unit when the bore holes reaches the mineralized strata. The resulting slurry moves upwardly into the surface through an eccentrically disposed inner pipe. Certain embodiments of the excavating unit are oscillated through a partial or a complete circle and include a nozzle directed in a horizontal direction to reduce a large segment of the material to be excavated to a slurry. Compressed air may also be directed into the cavity formed by the jet through a pipe which is apparently external of the water pipes to pressurize the cavity permitting the horizontal jet to operate in the air rather than underwater.

Sewell U.S. Pat. No. 2,537,605 which issued on Jan. 9, 1951 discloses several embodiments of an apparatus for drilling bore holes wherein water is directed downwardly in the borehole externally of the apparatus and in mud is drawn upwardly through a central conduit. Air is directed downwardly between an outer and inner conduit to aerate the mud and raise it to the surface.

Gilmore U.S. Pat. No. 2,745,647 which issued on May 15, 1956 discloses an apparatus for making underground storage cavities and for recovery of sediments from subterranean deposits. The apparatus, however, is lowered into a previously drilled and cased hole. Water is directed through horizontal nozzles to form the cavity, and air is directed into the cavity either through the nozzles or a separate tube to provide sufficient pressure to airlift the sediment to the surface through a central tube.

U.S. Pat. No. 3,393,013 which issued to Hammer et al on July 16, 1968 discloses a process for mining ore within a well that is drilled and cased by a drill unit. A pumping unit is then lowered into the casing and has a lower end that extends out of the bottom thereof. A jet stream is provided for directing jets of water against the ore to reduce the ore in a slurry. A production line having an ore lift string therein in provided to lift the slurry to the surface. The jet stream is rotatable about the non-rotatable production line; and both the jet stream and the production line may be reciprocated vertically relative to each other.

A paper dated July 20, 1976 by Flow Research Inc., Presentation No. 102, entitled "Field Demonstration of Hydraulic Borehole Mining of Coal", discloses a subterranean mining tool which is lowered into a hole previously bored into a coal strata. The apparatus includes three eccentric pipes with the outer pipes flanged and bolted together. The apparatus is rotated during mining and includes at least one mining nozzle for reducing the coal to a slurry, and a jet pump for lifting the slurry to the surface.

SUMMARY OF THE INVENTION

In accordance with the present invention a method and apparatus is provided for mining ore from subterranean deposits. A multi-section mining tool is rotatably received in a hole drilled from the surface into the ore strata being mined. The mining tool includes three separate fluid flow passages sealed from each other and extending downwardly into the ore strata. One of the flow passages is defined by an outer cylindrical conduit, and the other two conduits are disposed within the outer conduit and all three conduits are preferably eccentric to each other. A mining fluid, preferably water, is directed through one of the conduits and through a nozzle extending transversely of the tool string and movable in an arcuate path for directing a jet of liquid against the ore to reduce the ore to a slurry. Another fluid is directed downwardly through another conduit for discharge into the slurry and to create pumping or lifting means for lifting the slurry to the surface through a third or slurry return conduit.

In the first embodiment of the invention the slurry is lifted by a lifting fluid such as water which is directed upwardly into the bottom of the third or slurry return conduit through an eductor pump nozzle. In two other embodiments the slurry is lifted by a gas, preferably air, which is released within the slurry return conduit near its lower end for lifting the slurry to the surface.

In all embodiments independent control means at the surface are provided for independently varying the pressure and capacity of the mining fluid relative to the slurry lifting fluid. By independently controlling the mining and lifting fluid capacities, the level of the slurry in the ore cavity may be controlled so that the jet of liquid discharged from the mining nozzle may either operate in air above the slurry level for more effectively reducing the ore to a slurry; or may operate below the slurry level in a cavity completely filled with liquid in order to prevent the roof of the cavity from caving in.

A very important advantage for using separate conduits for mining and slurry lifting flows is to allow optimum pressure for both the mining nozzle and for the slurry lifting fluid. For example, when mining ore such as coal much higher mining nozzle pressures would be required as compared to mining pressures used when mining phosphates. Also, greater efficiency will be realized if pumping pressures can be varied according to the depth of operations.

In the preferred embodiment of the invention the multi-section mining tool has a drill bit secured to the lower end of the outer conduit and thus serves as both a drilling and a mining tool which drills and then mines within an uncased hole. During drilling the tool is rotated and built up section-by-section as the hole is being drilled. Also, during drilling, liquid from one of the conduits, which is a valved conduit, enters the drill bit to aid in drilling and to wash cuttings to the surface.

The slurry mining apparatus also includes a multi-section pipe string which includes an outer conduit having screw threaded sections and at least two inner eccentric conduits that are stab connected to adjacent sections of the multi-section pipe string and that are disposed within the outer conduit. Means are provided near each end of each pipe section to maintain the inner conduit in their eccentric relationship and to permit rotation thereof while preventing axial movement of the inner conduit section relative to their associated outer sections.

BRIEF DESCRIPTION OF THE DRAWINGS

FIG. 1 is a diagrammatic vertical central section taken through a first embodiment of the drilling and mining tool of the present invention illustrating the tool within an uncased hole in an ore strata after some ore has been removed leaving an ore matrix cavity, certain parts of the tool being cut away to reduce its height.

FIG. 2 is an enlarged diagrammatic central vertical section of a mining and drilling head forming the upper end of a drilling and mining tool.

FIG. 10 is a diagrammatic vertical central section similar to FIG. 9 but illustrating a modified valving system based on the density of the fluid directed into the valving system.

DESCRIPTION OF THE PREFERRED EMBODIMENT

Figure 3:
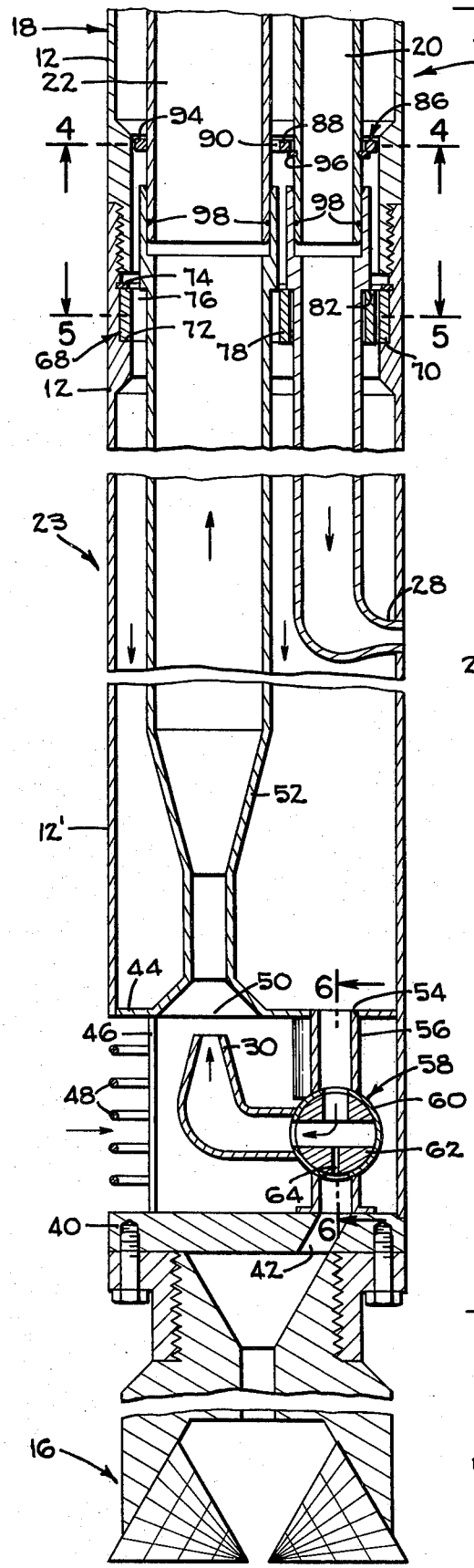
FIG. 3 is a diagrammatic vertical central section of the lower portion of the first embodiment of the invention which uses an eductor pump for lifting the slurry to the surface, a portion of the drill bit and the upper portion of the lowest section of the tool being cut away to forshorten the view and to illustrate the joint between two standard sections of the multi-section pipe string.

In general, the drilling and mining tool 10 (FIG. 1) of the present invention includes a plurality of axially aligned tool sections 12 having a drilling and mining head 14 on the upper end thereof and a drill bit 16 on the lower end thereof. Each of the sections 12 includes a section of a screw threaded outer conduit 18, a section of a stab connected processing fluid conduit 20, and a section of a stab connected slurry return conduit 22. The several tool sections 12 and the drill bit defines a tool string 23.

The drilling and mining tool 10 is first used to drill a hole 24 from the surface into an ore strata 26 to be mined. During drilling, the tool 10 (except for a portion of a head 14) is rotated and is assembled section-by-section as the hole 24 progresses downwardly into the ore strata 26. As indicated in FIG. 1, the hole may be drilled through hard rock, such as limestone, as well as through softer materials. The cuttings are lifted to the surface by a fluid that is directed into the hole 24 through the drill bit 16 during drilling. After the hole 24 is drilled, the rotatable portions of the tool 10 are slowly rotated and a liquid (hereinafter referred to as water) at high pressure is pumped from the surface through one of the conduits 18 or 20 and is discharged as a jet through a mining nozzle 28 against the ore to reduce it into a slurry.

In accordance with the first embodiment of the invention illustrated in FIGS. 1 and 3, water from another conduit is directed upwardly through an eductor nozzle 30 to lift the slurry to the surface for collection in a pond, pipe line, or other collecting device (not shown). The removal of ore in the ore strata 26 forms an ore matrix cavity 32 (FIG. 1).

It will be understood that the tool may be supported on the surface of the earth above the ore strata or may be supported by a barge (not shown) if the ore strata is below a lake or pond as in my aforementioned copending application.

The apparatus (not fully disclosed herein) for assembling and disassembling the tool, for rotating portions of the tool and holding other portions stationary while progressively assembling the tool sections, for rotating the tool during drilling, and for elevating and lowering the tool during drilling and mining are not critical to the present invention and may be the same as that disclosed and described in my U.S. Pat. No. 4,877,481.

Although the drilling and mining tool 10 is primarily intended to use in mining phosphate from one or more ore strata at depths between about 200 and 300 feet below the surface, it will be understood that the tool may be used at other depths for mining other types of ore including non-metallic materials. It will also be understood that the term "ore" as used herein includes coal, gravel, rocks or any other solids that the tool is capable of slurry pumping to the surface for collection above ground (or water) level in a pipeline or the like.

More particularly, the drilling and mining tool 10 (FIGS. 1–5) of the first embodiment of the invention comprises a drill bit 16 which is of the well known type described in my copending applications. The drill bit 16 is secured to a disc 40 welded to the lower end of the outer conduit 18, which end is the lowermost or mining section 12' of the tool 10. The disc 40 is provided with a port 42 through which water is directed during drilling thereby providing lubrication for the bit and providing means for washing cuttings to the surface. A second disc 44 is spaced above the disc 40 and is welded to the outer conduit above a slurry inlet opening 46 which is provided with a grille 48 to prevent excessively large pieces of ore, rocks, or the like from entering and clogging the slurry return conduit 22.

The disc 44 is provided with a first port 50 secured in fluid communication to the lower open end of a venturi tube 52 that forms a portion of the slurry outlet conduit 22. A second port 54 in the disc 44 communicates with one end of a short pipe section 56 which has its other end communicating with the port 42 in the disc 40. A valve 58 in the pipe section 56 has a ported housing 60 therein to which the inlet end of the eductor nozzle 30 is connected. When a valve core 62 in the valve housing is positioned in the illustrated mining position, water flows from the large outer conduit 18 through passages in the valve core and through the eductor nozzle 30 into the venturi tube 52 of the slurry return conduit 22 to lift the slurry to the surface. During mining, a small amount of water is preferably directed into the drill bit 16 through a small port 64 in the valve core 62 to prevent mud, rocks, and other debris from settling in the bottom of the hole 24 and thereby inadvertently locking the tool from rotation. During drilling, the valve core 62 is pivoted 90° in a clockwise direction thus closing the main passage to the eductor nozzle 30 but allowing a small amount of water from port 64 to maintain the eductor nozzle 30 clear of mud. A much larger amount of water flows into the drill bit at sufficient drilling pressure and capacity to flush cuttings to the surface externally of the cylindrical outer conduit. It will be understood that during drilling, under-reamers 66, illustrated only in FIG. 1, of the drill bit 16 are pivoted outwardly to drill the hole 24 which is of sufficient diameter to loosely receive the tool 10. The apparatus for pivoting the valve core 62 between its two positions may be of any suitable type and examples of suitable types will be described hereinafter.

The mining nozzle 28 (FIG. 3) is formed on the lower end of the processing fluid conduit 20 and has its outlet end rigidly secured and sealed to a hole in the outer conduit 18. Water at high pressure flowing through the conduit 20 is discharged as a jet from the nozzle 28 which is directed transversely of the tool in a generally horizontal direction when the hole 24 is drilled vertically downward.

Figure 5:
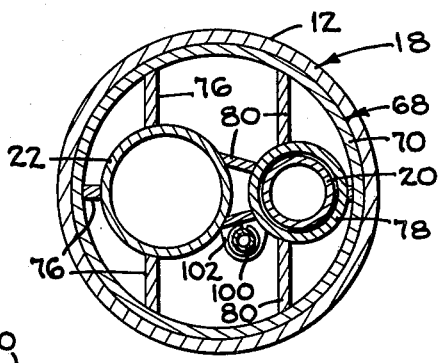
FIG. 5 is a transverse section taken along lines 5—5 of FIG. 3 illustrating a conduit centering and supporting spider rotatably received in the internally threaded end of each standard section of the conduit.

The upper end portions of the section of conduit 20 and 22 in each tool section 12, is supported within the outer conduit by a spider 68 (FIGS. 3 and 5). The spider 68 includes an annulus 70 that is rotatably received within the internally threaded upper end portion of the associated outer section of conduit 18. The spider 68 is held from axial movement relative to the conduit 18 by a shoulder 72 on the outer conduit 18, and a snap ring 74 or the like positioned within a groove in the outer conduit section. The associated section within the annulus 70 is rigidly secured to the slurry return conduit 22 by webs 76. The associated section of the processing fluid conduit 20 is loosely received in a ring 78 that is rigidly secured to the annulus 70 and to the associated section of the slurry return conduit 22 by webs 80. A shoulder 82 on the upper end of the associated section of conduit 20 rests against the ring 78 to prevent the conduit section from moving down when positioned as indicated in FIG. 3.

In order to support the upper ends of the inner conduit in the lowermost of mining section 12 of the tool string 12, a spider (not shown) which is identical to the above described spider 68 is preferably welded to both inner conduits 20, 22 and to the outer conduit 18 to provide a rigid support for the inner conduit section.

Figure 4:
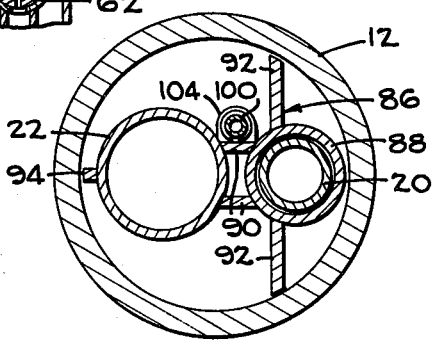
FIG. 4 is a transverse section taken along lines 4—4 of FIG. 3 illustrating a conduit centering bracket.

The lower end of each section 12 of the conduits 20 and 22, including the conduit sections in the drilling and mining head 18 but excluding the conduits in the lower section 12', are held in desired position within the associated section of outer conduit 18 by a bracket 86 (FIGS. 3 and 4). The bracket 86 comprises a ring 88 that loosely receives the associated section of conduit 20 and which is rigidly secured to the associated section of conduit 22 by webs 90. Two ears 92 are welded to the ring 88 and a third ear 94 is welded to the associated section of conduit 22. The outer ends of the ears 92 and 94 are spaced a short distance from the internal surface of the outer conduit 18 to permit self aligning lateral movement and relative rotation between the outer conduit section and the associated sections of the inner conduits 20, 22. A snap ring 96 (FIG. 3) is attached to the lower end portion of the associated section of conduit 20 and abutts the lower surface of the ring 88.

Thus, the associated sections 12 of conduits 20 and 22 are held from axial movement relative to each other and to the associated section of the outer conduit 18 by the snap rings 74 and 96 and the shoulders 72 and 82. When the tool 10 is being assembled (or disassembled) section-by-section with the aid of structure of the type disclosed in my aforementioned copending applications, it will be noted that the stab joints between the sections of the inner conduits 20, 22 are moved axially together and sealed by O-rings 98. During assembly or disassembly of any joint in the tool, the lower section including the inner conduits 20, 22, are clamped from rotation while the added section of the outer conduit 18 is screwed into or out of the next lower outer conduit section. The portions of the inner conduits of the added section 12 are stabbed into the associated stationary inner conduits therebelow and are accordingly held stationary while the added outer conduit is being screwed into the next lower section. Thus, the newly added inner conduits prevent rotation of the associated spider 68 and bracket 86. This feature has the advantage of minimizing damage to the O-rings 98 by not subjecting them to relative rotation. The loose fit of the sections of conduit 20 within the rings 78 and 88 and the loose fit between the bracket 86 and the sections of the outer conduit 18 minimize alignmemt problems when making the stab connections.

If a separate control conduit 100 (FIGS. 2, 4 and 5) having a swivel joint 100' on its upper end is desired to actuate the valve 58 from the surface, sections of the control conduit 100 are connected together by stab joints and are connected to their associated conduit sections by ears 102 and 104 welded to associated spider 68 and brackets 86. A suitable source of fluid at high pressure and suitable control valves (not shown) are connected to the swivel joint.

Other advantages of constructing the tool section 12 with a threaded outer conduit section 18 and stab connected, eccentrically disposed inner tool sections are as follows:

1. The tool sections 12 uses smaller pipes, of less weight with more total cross-sectional area for accommodating the same flow with less friction loss as compared to concentric conduits.

2. The stab joints when eccentrically mounted prevent all rotation in the glands during makeup thereby minimizing the scoring of gland surfaces.

3. Additional sensing and control conduits or the like of the tool are more easily added.

4. In regard to the threaded outer conduit section 18 as compared to flanged section; threaded connections are faster to make-up and break, are much stronger in tension and torsion, and produce less restriction in the flow path at the joint.

5. The alignment of successive inner conduit sections provides a reference, such as arrows on the rotatable portion of the head 14, at the surface as to the angular location of the mining nozzle and slurry opening at the bottom of the tool string. The drilling and mining head 14 is supported by a crane 110 (FIGS. 1 and 2) (only the cable being shown) and is used during both drilling and mining. The head 14 is coupled an uncoupled from each section 12, in turn, as the hole 24 is being drilled downwardly into the ore strata. Upon reaching the desired depth, the head 14 remains attached to the uppermost conduit section during mining.

The drilling and mining head 14 (FIG. 2) comprises and outer non-rotatable housing 112, an externally threaded outer conduit supporting sleeve 114 rotatable within said housing 112, and an inner conduit support 116 rotatable relative to both the housing 112 and the sleeve 114 for supporting the upper section of the processing fluid conduit 20' and the slurry return conduit 22'. The inner conduit support is preferably marked by arrows or the like to indicate the radial direction of the mining nozzle 28 and slurry inlet.

Complementary concave portions of a ball race 118 are formed in the sleeve 114 and in the lower portion of the housing 112 for receiving a plurality of balls 120 that may be inserted into the ball race 118 through a hole 121 in the housing which is thereafter closed by a plug 112 thus defining a ball bearing 124 between the sleeve and the housing. A similar ball bearing 126 is formed between the inner conduit support 116 and the housing 112.

A processing fluid inlet port 128 and an annular passage 130 formed in the non-rotatable housing 112 communicates with an L-shaped passage 132 in rotatable inner conduit support 116 for directing fluid into the processing fluid conduit 20. Likewise, a slurry outlet port 134 and an annular passage 136 formed in the housing 112 communicates with an elbow 138 formed in the support 116 that receives slurry being lifted from the ore strata during mining. A third port 140 in the housing 112 directs fluid into the space within the outer conduit 18 that is not occupied by conduits 20 and 22, which outer conduit includes the sleeve 114 for flow downwardly into the ore strata. Suitable dynamic seals 142 are provided to isolate the fluids passing through the ports 128, 134 and 140 from each other.

Since the sleeve 114 and inner conduit support 116 are rotatable relative to each other and to the housing 112 during drilling, it is apparent that the sleeve 114 is screwed into the upper conduit section (or removed from the upper conduit section) while that upper section, and accordingly the inner conduits 20, 22 and support 116, are held from rotation by means similar to that disclosed in my aforementioned application. During mining, the outer conduit 18 including the sleeve 114; and the inner conduits 20, 22 and their support 116 rotate as a unit.

The uppermost portion 22' of the slurry return conduit 22 is flanged and is bolted to the elbow 138; while the uppermost portion 20' of the processing fluid conduit 20 is stab fitted into a counterbore in the L-shaped passage 132 and is sealed thereto by an O-ring 144. One of the brackets 86 is welded to the conduit section 22' and supports the conduit section 20' as previously described for stabbing into the next lower conduit section in sealed engagement.

A motor 146 secured to the non-rotatable housing 112 powers a gear drive 150 or the like which includes a small diameter gear 152 that meshes with a large diameter gear 154 secured to the sleeve 114. A driven variable speed pump p1 (FIG. 1) is connected to the fluid supply conduit 20 by a conduit 156 having a control valve V1 therein. Either the speed of pump P1 or the valve V1 may be varied for controlling the head and capacity of fluid that is directed through the mining nozzle 28 for reducing the ore to a slurry. Another driven variable speed pump p2 is connected to the conduit 18 by a conduit 158 having a control valve V2 therein, which pump P2 or valve V2 may be adjusted for controlling the pressure and capacity of fluid therein during drilling and also during mining. In the first embodiment of the invention the fluid entering the conduits 18 and 20 is preferably water. It is also apparent that provision of separate conduits 18, 20 and separate controls P1, V1 and P2, V2 for the mining nozzle 28 and eductor nozzle 30 allow pressures for each function to be optimized.

Figure 6:
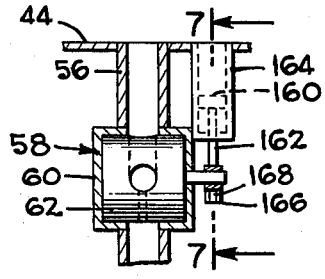
FIG. 6 is a section taken along lines 6—6 of FIG. 3 illustrating a valve actuating mechanism.
Figure 7:
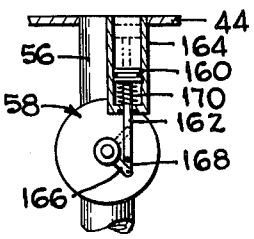
FIG. 7 is a section of the valve actuating mechanism of FIG. 6 taken along lines 7—7 of FIG. 6.

Any suitable means can be used to shift the valve 58 between its mining and drilling positions. For example, FIGS. 6 and 7 diagrammatically illustrate a piston 160 and piston rod 162 slidably received in a cylinder 164 which, in accordance with the first embodiment of the invention opens into the outer conduit 18. The piston rod 162 is pivotally connected to a lever 166 rigidly connected to the valve core 62 by link 168. A spring 170 of sufficient force to exceed the pressure of the fluid in the conduit 18 during drilling urges the piston upwardly to the dotted line position (FIG. 7). Thus, during drilling, the spring shifts the valve 90° in a clockwise direction (FIG. 3) causing substantially all of the fluid to flow into the drill bit 16 at this time. During mining, the fluid pressure in the outer conduit 18 is in excess of the force exerted by the spring 170 thus positioning the valve in the solid line mining position illustrated in FIGS. 3, 6 and 7. The piston rod 162, lever 166 and linkage 168 are preferably positioned within a housing (not shown) to prevent debris from fouling the operation of the valve. The pressure and capacity in the outer conduit 18 is of course controlled at the surface by variable speed pump P2 and/or valve V2. Also, during mining, variable speed pump P1 and/or valve V1 may be controlled to vary the pressure and capacity of liquid passing through the nozzle 28.

Instead of the cylinder 164 communicating with the outer conduit 18 as above described, the previously mentioned control line 100 (FIGS. 2, 4 and 5) may be connected to the upper end of the cylinder 164 thus controlling the valve 58 independently of the pressure within the outer conduit 18. Thus, valves and fluid supply equipment (not shown) at the surface may be controlled by an operator to modulate the capacity of flow of liquid through the eductor nozzle 30 (FIG. 3). In this way the pressure of slurry level in the ore matrix cavity may be controlled. The fluid within the control conduit 100 may be either a gas or a liquid.

Figure 3A:
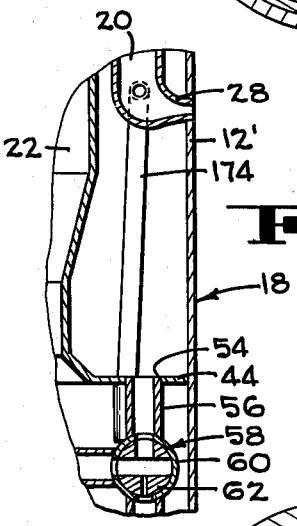
FIG. 3A is a fragment of the eductor section of FIG. 3 taken at a smaller scale and illustrating a modified conduit arrangement for actuating a valve.

In addition to the two above ways to operate the valve 58, a third alternate power source to operate the valve 58 may be the fluid in conduit 20. In this regard an alternate branch line 174 (FIG. 3A) is connected between the cylinder 164 and the conduit 20 so that when high pressure mining liquid enters conduit 20 the valve 58 will shift to its illustrated mining position.

Use of the conduit 174 (or conduit 100) and the pressure within the control conduit 174 to actuate the valve 58 is desirable when mining relatively shallow ore strata. For example, when the ore strata is at a level wherein the optimum drilling pressure is greater than the optimum slurry pumping pressure, it would not be desirable to rely on the pressure within outer conduit 18 to shift valve 58 to its illustrated mining position.

Figure 8:
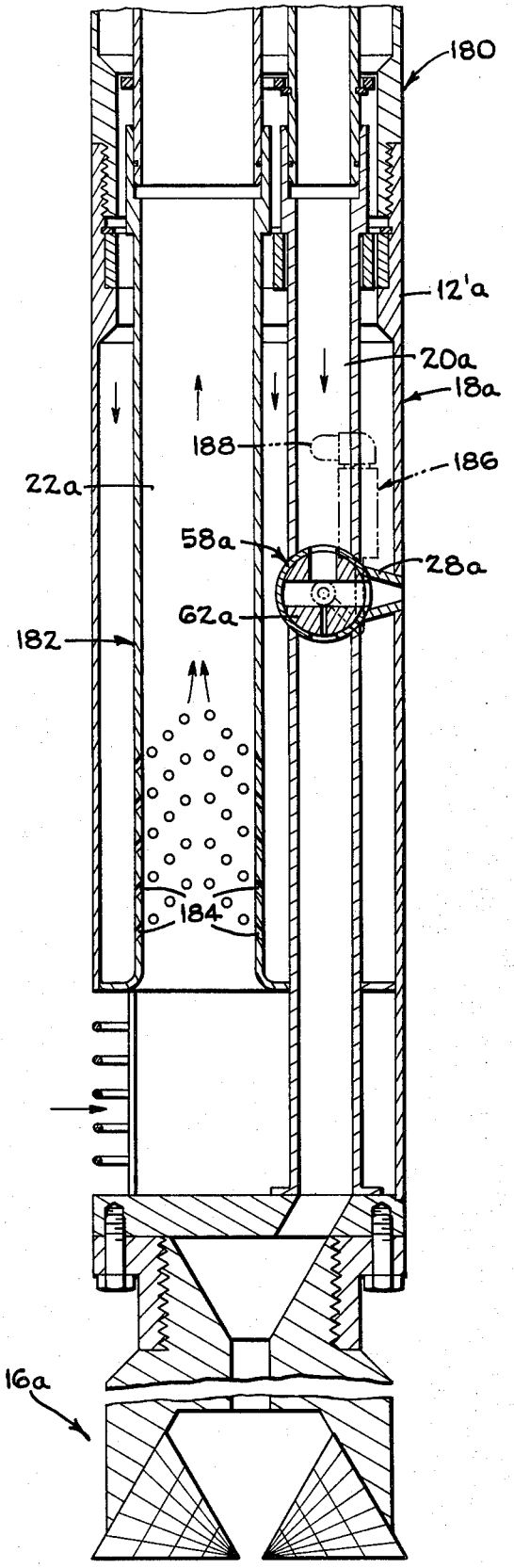
FIG. 8 is a diagrammatic vertical central section similar to FIG. 3 but illustrating the lower portion of a second embodiment of the invention having means defining an air lift or pump for lifting the slurry to the surface.

The second embodiment of the invention illustrates a drilling and mining tool 180 (FIG. 8) which is substantially the same as the first embodiment of the invention except that it uses an air pump 182, rather than an eductor pump 30 (FIG. 3), for raising the slurry to the surface. Accordingly, parts of the drilling and mining tool 180 which are equivalent to parts of the drilling and mining tool 10 of the first embodiment will be assigned the same numerals followed by the letter "a".

The components of the tool 180 are the same as in the first embodiment except for the fluids and pumping equipment used and the tool section 12'a. Air at high pressure is directed downwardly through the outer conduit 18a for flowing into the slurry return conduit 22a through holes 184 near the bottom of the slurry return conduit 22a. The air bubbles entering the slurry reduces the specific gravity of the slurry and raises the slurry to the surface in a manner well known in the art. The valve 58a is positioned in the processing fluid conduit 20a for directing a liquid, preferably water, through the mining nozzle 28a when positioned as indicated; or into the drill bit 16a when rotated 90° in the counterclockwise direction.

The valve 58a may be actuated by means of a piston and cylinder unit 186 similar to that shown in FIGS. 6 and 7 but mounted on the other side of the axis of rotation of the valve core 62a (assuming the mining pressure is higher than the drilling pressure) since the direction of rotation of the cores 62 and 62a are opposite from each other. The fluid receiving end of the piston and cylinder unit which controls the actuation of the valve 58a may be connected to either the processing fluid conduit 20a at 188, the conduit 188a, or to a separate control conduit similar to control conduit 100 (FIG. 2). The valve 58a may be controlled from the surface to shift the core 90° between its illustrated mining mode to its drilling mode. Valves V1 and V2 or pumps P1 and P2, which pump P2 is an air compressor in this embodiment, may also be independently controlled to change the pressure and capacity of the mining liquid and also to change the rate of flow of slurry to the surface. As in the first embodiment of the invention the cavity pressure or slurry level may be independently controlled from the surface.

The third embodiment of the invention illustrates a drilling and mining tool 190 (FIG. 9) which is substantially the same as the second embodiment of the invention except that an air lift or pump 192 receives its air during mining from the processing fluid conduit 20b and the valve 58b. During drilling the valve core 62b is shifted 90° in a clockwise direction by control means of the type disclosed in FIGS. 6 and 7 to direct the fluid (either air or water) downwardly through the valve 58b and into the drill bit 16b. The pressure receiving end of the piston and cylinder unit 193 which controls the rotation of the core 62b may be connected to the fluid in the processing fluid conduit 20b at 194, to the fluid in conduit 18b by a branch conduit (not shown), or may be connected to an independent control line similar to line 100 (FIG. 2) as in the other embodiments. With the piston and cylinder unit 193 positioned as illustrated in FIG. 3 it is assumed that the drilling pressure is higher (for example 350 psig) than the air lift pressure (for example about 80 psig).

Figure 9:
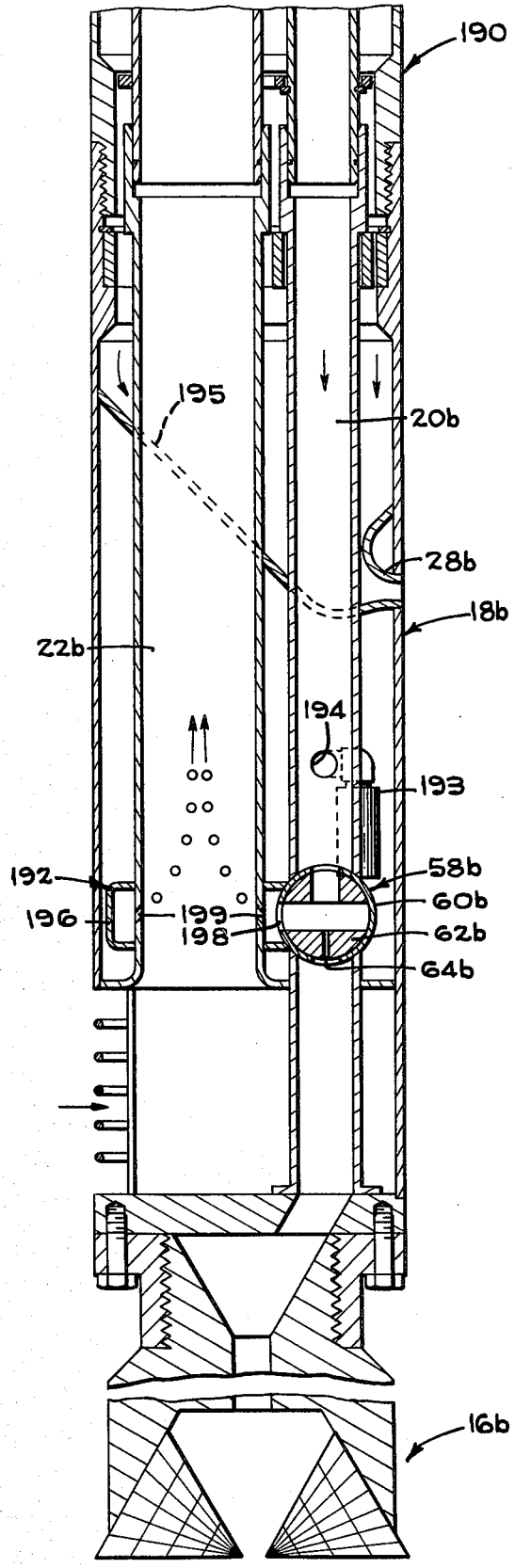
FIG. 9 is a diagrammatic vertical central section illustrating the lower portion of a third embodiment of the invention having means defining an air lift or pump and a different conduit arrangement from that disclosed in FIG. 8.

A sloping baffle 195 communicates with the mining nozzle 28b and is apertured and sealed to the outer walls of the slurry return conduit 22b and to the processing fluid conduit 20b thereby directing all mining liquid (preferably water) through the mining nozzle 28b under the control of pump P2 (FIG. 1) and/or valve V2. A U-shaped fluid dispensing ring 196 provides a fluid distribution chamber around the slurry return conduit 22b which communicates with a port 198 in the housing 60b of the valve 58b. Thus, when the valve core 62b is positioned as indicated in FIG. 9, fluid such as air is directed from a fluid pump, which is substituted for the pump P1 (FIG. 1) through valve V1, conduit 20b (FIG. 9) valve 58b, dispensing ring 196 and ports 199 in the conduit 22b to raise the slurry to the surface through slurry return conduit 22b. During mining a small amount of air is directed into the drill bit through small port 64b in the valve 58b for release externally of the tool thereby preventing debris from settling in the bottom of the hole which might otherwise lock the tool from rotation within the hole. During drilling the valve core 62b is shifted 90° in a clockwise direction (FIG. 9) and water or air flows into the drill bit 16b to flush cuttings to the surface. If water is used during drilling, a separate pump (not shown) is provided for directing the water into the processing fluid conduit 20b during drilling.

FIG. 10 illustrates a portion of a fourth embodiment of the drilling and mining tool 200 of the present invention, which tool is quite similar to the third embodiment of the invention except a different type of valve 202 is used. Accordingly, parts of the tool 200 which are equivalent to parts of the other embodiments will be assigned the same numerals followed by the letter "c".

The drilling and mining tool 200 comprises an outer conduit 18c, a processing fluid conduit 20c, and a slurry return conduit 22c. The mining nozzle 28c receives its liquid from the outer conduit 18c which is sealed from the other conduits by a sloping baffle 195c.

In the present form of the invention water is directed into the processing fluid conduit 20c during drilling and air is directed into conduit 20c during mining.

The valve 202 includes a housing 204 having ports 206, 208 and 210 that are connected to the conduit 20c, the drill bit (not shown) by conduit 212, and to the air lift or pump 192c by a conduit 214, respectively. A ball 216 which floats in water but is heavier than air is positioned within the housing 204. Thus, during mining when air is directed into the valve 202, the ball 216 drops and closes the port 208 to the drill bit. During drilling when water is directed into the valve 202, the valve floats and thus closes the port 210 leading into the air pump 192c.

If desired, the control line 100 (FIG. 2) (or other conduits not shown) may be used for detecting the level or pressure in the cavity 32 (FIG. 1), or can be used to add additional diluting water to the slurry which might be necessary when using the drilling and mining tools which use air lifts for raising the slurry to the surface.

From the foregoing description it is apparent that the drilling and mining tool of the present invention comprises a three conduit system (plus additional sensor/-control conduits if desired) with the conduits being disposed within an outer conduit and preferably eccentric relative to each other. A valve that is controlled from the surface is provided for directing sufficient water (or air) into the drill bit to lift cuttings to the surface during drilling. The pressure and capacity of the slurry lifting fluid which may be a liquid such as water or a gas such as air; and the pressure and capacity of the mining liquid may be independently controlled at the surface to vary the mining and pumping pressure, to vary the pressure or level of slurry in the ore cavity.

Although the best mode contemplated for carrying out the present invention has been herein shown and described, it will be apparent that modification and variation may be made without departing from what is regarded to be the subject matter of the invention.

I claim:

1. A drilling and mining method for first drilling a hole from the surface into a subterranean ore strata with a multi-section drilling and mining tool including a tool string with a drill bit at its lower end and thereafter removing ore from the strata with the tool, comprising the steps of progressively rotating and lowering the tool string to drill a hole from the surface to the ore strata, assembling the tool section by section as the drilling progresses and until the lower end of the tool enters the ore strata to be mined, directing a fluid at a first pressure and capacity downwardly along a first path into the bottom of a hole being drilled during drilling to lift cuttings to the surface, directing another fluid downwardly along a second path isolated from said first path during mining, directing and processing liquid along one of said paths during mining at a second pressure and capacity and diverting it from its downward path into a jet of liquid projecting transversely of the tool against the ore to form a slurry of ore and liquid, and releasing a fluid at a third pressure and capacity during mining from adjacent the bottom of the other of said paths into the slurry in a slurry return path isolated from the other two paths for lifting the slurry to the surface.

2. A method according to claim 1 and additionally comprising the steps of moving the jet of liquid through an arcuate path transversely of the tool.

3. A method according to claim 1 and additionally comprising the step of raising or lowering the tool during mining.

4. A method according to claim 1 wherein said fluid released into said slurry return path is a liquid which is directed upwardly into said slurry return path through an eductor pump for entraining and lifting the slurry to the surface.

5. A method according to claim 1 wherein said fluid released into said slurry return path is a gas such as air, and wherein said gas is directed into said slurry return path for entraining and lifting the slurry to the surface.

6. A method according to claim 1 and additionally comprising the step of independently controlling the pressure and capacity of the liquid and the pressure and capacity of the fluid during mining for maintaining the jet of liquid below the surface of the slurry in the ore strata being mined.

7. A method according to claim 1 and additionally comprising the step of independently varying the pressure and capacity of said jet of liquid during mining for compensating for differences in the hardness of the ore being reduced to a slurry and for compensating for the varying distance between the tool and the ore being reduced to a slurry.

8. A method according to claim 7 wherein said fluid released into said slurry return path is a liquid which is directed upwardly into said slurry return path through an educator pump for entraining and lifting the slurry to the surface.

9. A method according to claim 7 wherein said fluid released into said slurry return path is a gas such as air, and wherein said gas is directed into said slurry return path for entraining and lifting the slurry to the surface.

10. A method according to claim 7 and additionally comprising the step of independently controlling the pressure and capacity of the liquid and the pressure and capacity of the fluid during mining for maintaining a prescribed pressure in the cavity.

11. A method according to claim 7 and additionally comprising the step of independently controlling the pressure and capacity of the liquid and the pressure and capacity of the fluid during mining for maintaining the jet of liquid below the surface of the slurry in the ore strata being mined.

12. A method according to claim 1 and additionally comprising the step of independently controlling the pressure and capacity of the liquid and/or the pressure and capacity of the fluid during mining for maintaining the jet of liquid above the surface of the slurry in the ore strata being mined.

13. A method according to claim 12 wherein said fluid is a liquid.

14. A method according to claim 12 wherein said fluid is a gas.

15. A drilling and mining method for first drilling a hole from the surface into a subterranean ore strata with a multi-section drilling and mining tool having a drill bit at its lower end and thereafter removing ore from the strata with the tool, comprising the steps of; progressively rotating and lowering the tool to drill a hole from the surface to the ore strata, assembling the tool section-by-section as the drilling progresses and until the lower end of the tool enters the ore strata to be mined, rotating an upper outer section of the tool and holding the lower portion of the tool from rotation during assembly of the tool, directing a processing fluid at a first pressure and capacity downwardly from the surface along a first path into the bottom of the hole being drilled during drilling to lift cuttings to the surface, directing a mining liquid during mining at a second pressure and capacity downwardly from the surface along a second path isolated from said first path and then outwardly as a jet of liquid projecting transversely of the tool against the ore to reduce the ore to a slurry, moving the transverse jet of liquid in an arcuate path about the axis of the tool during mining for reducing the ore within the effective range of the arcuate path of the jet into a slurry, and diverting the major portion of a processing fluid from said first path during mining at a third pressure and capacity from its downward path into the bottom of the hole into a slurry return path to lift the slurry to the surface.

16. A method according to claim 15 wherein the fluid directed to the slurry return path is a liquid.

17. A method according to claim 15 wherein the fluid diverted to the slurry return conduit is a gas.

18. A method according to claim 15 including the step of varying the pressure and capacity of said mining liquid to control the rate of reducing the ore to a slurry.

19. A method according to claim 15 and additionally comprising the step of controlling the pressure and capacity of the processing fluid and the mining liquid during mining for varying the slurry level and pressure in the ore cavity.

20. A drilling and mining method for first drilling a hole from the surface into a subterranean ore strata with a multi-section drilling and mining tool having a drill bit at its lower end and thereafter removing ore from the strata with the tool, comprising the steps of; progressively rotating and lowering the tool to drill a hole from the surface to the ore strata, assembling the tool section by section as the drilling progresses and until the lower end of the tool enters the ore strata to be mined, directing a processing liquid at a first pressure and capacity downwardly along a first predetermined path into the bottom of a hole being drilled during drilling to wash the cuttings to the surface, diverting a major portion of the processing liquid at a second pressure and capacity from its downward path into a jet of liquid projecting transversely of the tool and moving through an arcuate path transverse of the tool for discharge from the tool against the ore to form a slurry of ore and liquid, directing a fluid at a predetermined pressure and capcity downwardly along a second path isolated from said first path and releasing said fluid from adjacent the bottom of the second path into the slurry in a slurry return path isolated from the other two paths for pumping the slurry to a surface.

21. A method according to claim 20 wherein the fluid directed to the slurry return path is a gas.

22. A method according to claim 20 including the step of varying the pressure and capacity of said liquid during mining to control the rate of reducing the ore to a slurry.

23. A method according to claim 20 and additionally including the step of controlling the pressure and capacity of the processing fluid and the liquid during mining for varying the slurry level and pressure in the ore cavity.

24. A method according to claim 20 wherein said arcuate path of said jet is a full circle.

25. In a slurry mining apparatus, a conduit section comprising; an outer conduit having screw threads on both ends for threaded attachment to other sections, means defining at least two inner conduits eccentrically disposed within the outer conduit and having complementary stab connectors on opposite ends thereof, a first inner conduit mounting means near one end of each conduit rotatably received and held from axial movement within the outer conduit for supporting the weight of both inner conduits from one end when the conduits are vertically oriented, and a second inner conduit supporting means rigidly secured to one of said inner conduits and loosely receiving said other conduits.

26. An apparatus according to claim 25 wherein one of said inner conduits is rigidly secured to said first mounting means and another inner conduit is loosely received in said first mounting means.

27. An apparatus according to claim 26 wherein removable abutment means is releasably connected between one of said inner conduits and the supporting means within which it is loosely supported.

28. In a slurry mining apparatus which includes a multi-section tool string, the combination of an outer conduit having threaded pipe sections screwed together as the sections are assembled, at least two inner conduits eccentrically disposed within the outer conduit and each inner conduit including sections adapted to be stab fitted together, and inner conduit support means near one end of each pipe section for maintaining said one end of each inner conduit in said eccentric relationship and to permit rotation thereof while preventing axial movement of said inner conduit sections relative to their associated outer sections in one direction.

29. An apparatus according to claim 28 wherein said support means defines a first mounting means, and additionally comprising second mounting means, said first and second mounting means being rotatably received within said outer conduit near opposite ends of associated sections with each of said mounting means rigidly secured to one of said inner conduits while loosely receiving another inner section to maintain said inner sections eccentric to each other and also permitting ease in aligning the inner sections when being stabbed together.

30. An apparatus according to claim 29 wherein each of said mounting means is rigidly secured to the same inner conduit section.

31. An apparatus according to claim 29 wherein said first mounting means is a spider having an outer annulus rotatably received near one end of the associated outer pipe section.

32. An apparatus according to claim 29 and additionally comprising a first abutment means for maintaining one of said mounting means from axial movement within its associated outer conduit section, and second abutment means for maintaining the associated inner conduit section that is loosely received in said one mounting means from substantial axial movement relative thereto.

33. An apparatus according to claim 32 wherein said abutment means for maintaining said loose inner conduit section from axial movement is associated with the other mounting means.

34. An apparatus according to claim 28 wherein one of said supporting means is loosely guided within said outer conduit.

35. In a slurry mining apparatus which includes a multi-section tool string: the combination of an outer conduit having threaded pipe sections screwed together as the sections are assembled; at least two inner conduits eccentrically disposed within the outer conduit and each inner conduit including sections adapted to be stab fitted together; inner conduit support means near one end of each pipe section for maintaining said one end of each inner conduit in said eccentric relationship and to permit rotation thereof while preventing axial movement of said inner conduit sections relative to their associated outer sections in one direction; and a drilling and mining head; said head comprising a non-rotatable housing having means defining a fluid inlet passage and a fluid outlet passage therein, a sleeve journaled for rotation within and held from axial movement relative to said housing, said sleeve including a lower threaded end adapted to be screwed into the upper end of said uppermost outer conduit section for supporting said pipe string and establishing flow communication between one of said passages and the other conduit, an inner conduit support journaled for rotation and held from axial movement within said housing and having means defining at least two fluid passageways therein establishing flow communication between said inner conduits and associated passages in said housing with the fluid flow in each conduit isolated from the flow in the other conduits.

36. An apparatus according to claim 35 wherein said passageways in said inner conduit support includes a first inner conduit section rigidly secured to said support and stabbed into the upper end of one of said inner conduits, and a second inner conduit section stab connected into both said inner conduit support and the other inner conduit, a support bracket rigidly secured to said first inner conduit section and loosely received within said sleeve and about said second inner conduit section, and means releasably supporting said second inner conduit section from axial movement relative to said support bracket.

37. A subterranean drilling and mining apparatus for first drilling a hole from the surface into an ore strata and thereafter reducing the ore to a slurry and lifting the slurry to the surface comprising; means defining a multi-section outer conduit having a slurry inlet opening adjacent the lower end thereof, a drill bit secured to the lower end of said outer conduit, a multi-section slurry return conduit within said outer conduit and having its lower end communicating with said slurry inlet opening, slurry pumping means for pumping slurry from said inlet opening to the surface through said slurry return conduit, a multi-section processing fluid conduit within said outer conduit for directing a processing fluid downwardly toward the lower end thereof, means for supporting and rotating said conduits during drilling and mining, means for selectively directing fluids into or out of said conduits and for sealing the fluid paths in each conduit from each other, a mining nozzle having its outer end secured to a port in said conduit and having its inner end communicating with one of said paths, one of said conduits including a portion communicating with said drill bit, and control means for selectively controlling the flow of fluid through the said one conduit into said drill bit during drilling and for discharging a processing fluid into a slurry of liquid and ore during mining.

38. An apparatus according to claim 37 wherein said control means includes controls at the surface for varying the pressure and capacity of the fluid in said processing fluid conduit and in said outer conduit for controlling the mining rate.

39. An apparatus according to claim 37 wherein the inlet end of said mining nozzle is connected to said processing fluid conduit and wherein the fluid in said processing fluid conduit during mining is water.

40. An apparatus according to claim 37 wherein said one conduit is said processing fluid conduit, wherein the fluid in said processing fluid conduit during mining is a liquid, and wherein the inlet end of said mining nozzle is connected to said processing fluid conduit during mining for causing liquid flowing in said processing fluid conduit to be directed out of said mining nozzle to reduce the ore to a slurry.

41. An apparatus according to claim 37 wherein said one conduit is said processing fluid conduit, wherein said fluid in said processing fluid conduit is air under pressure during drilling and during mining, said inlet end of said mining nozzle communicating with said outer conduit for directing a liquid therethrough during mining.

42. An apparatus according to claim 37 and additionally comprising means for independently varying the pressure of the processing fluids being directed downwardly into said outer conduit and into said processing fluid conduit from the surface.

43. An apparatus according to claim 37 wherein said control means includes valving means, and actuating means for selectively shifting said valving means to direct the major portion of the fluid in said one conduit into the drill bit during drilling and into said pumping means during mining to lift the slurry to the surface.

44. An apparatus according to claim 43 wherein said means for selectively shifting said valving means is responsive to changes in pressure of the fluid in said one conduit.

45. An apparatus according to claim 43 wherein said means for selectively shifting said valving means is responsive to changes in pressure of fluids in one of said other conduits.

46. An apparatus according to claim 43 wherein said means for selectively shifting said valving means is responsive to changes in the density of fluids in said one conduit.

47. An apparatus according to claim 43 wherein said one conduit is said outer conduit, wherein said pumping means comprises an eductor nozzle communicating with said outer conduit through said valve means, said valve actuating means being actuated to direct fluid flow from said outer conduit, through said eductor nozzle and through said slurry conduit to the surface during mining.

48. An apparatus according to claim 43 wherein said pumping means is a fluid operated, slurry lifting pump.

49. An apparatus according to claim 48 wherein said fluid directed through said lifting pump and into said slurry return conduit during mining is air.

50. An apparatus according to claim 48 wherein said fluid lifting pump is an eductor pump and wherein the fluid directed through said eductor pump and into said slurry return conduit during mining is water.

51. An apparatus according to claim 48 and additionally comprising means defining a plurality of openings in the slurry return conduit near its lower end, and means for directing high pressure air from one of the other conduits through said opening to provide an air pump for lifting the slurry to the surface during mining.

52. An apparatus according to claim 37 wherein said slurry return conduit and said processing fluid conduit are eccentrically positioned within said outer conduit and additionally comprising conduit mounting means for maintaining said slurry return and processing fluid conduits substantially parallel to said outer conduit.

53. An apparatus according to claim 52 wherein the sections of said outer conduit are screwed together, and wherein the sections of said slurry return conduit and said processing fluid conduit are connected together by stab connections.

54. An apparatus according to claim 52 wherein said conduit mounting means comprises a spider rigidly secured to one end of one of said conduits within the outer conduit and loosely received about the other conduit within said outer conduit, said spider including an annulus rotatably received within the associated section of said outer conduit, means for releasably holding said spider from axial movement relative to the associated section of said outer conduit, a bracket rigidly secured to the other end of one of said conduits within said outer conduit and loosely receiving said other conduit within said outer conduit, abutment means included in said bracket rotatably received and centered within said outer conduit, and means for preventing relative axial movement between said slurry return conduit and said processing fluid conduit.

* * * * *

UNITED STATES PATENT OFFICE

CERTIFICATE OF CORRECTION

Patent No. 4,134,619 Dated January 16, 1979

Inventor(s) PHILIP R. BUNNELLE

It is certified that error appears in the above-identified patent and that said Letters Patent are hereby corrected as shown below:

Column 2, line 17, change "holes" to --hole--.
Column 2, line 34, change "in" to --the--.
Column 2, line 53, change "in" to --to--.
Column 2, line 54, change "in" to --is--.
Column 5, line 26, change "4,877,481" to --4,077,481--.
Column 5, line 28, change "to" to --for--.
Column 6, line 46, change "of" to --or--.
Column 7, line 26, change "alignmemt" to --alignment--.
Column 7, line 62, change "an" to --and--.
Column 7, line 68, change "and" to --an--.
Column 8, line 57, change "pl" to --P1--.
Column 8, line 63, change "p2" to --P2--.
Column 9, line 40, change "of" to --or--.
Column 10, line 22, change "188a" to --18a--.

Signed and Sealed this

*Thirty-first* Day of *July 1979*

[SEAL]

*Attest:*

*Attesting Officer*

LUTRELLE F. PARKER
*Acting Commissioner of Patents and Trademarks*